US009323172B2

(12) United States Patent
Iwama

(10) Patent No.: US 9,323,172 B2
(45) Date of Patent: Apr. 26, 2016

(54) IMAGE FORMING APPARATUS PROVIDED WITH IMAGE FORMATION POSITION CORRECTION FUNCTION

(71) Applicant: Brother Kogyo Kabushiki Kaisha, Nagoya-shi, Aichi-ken (JP)

(72) Inventor: Noritaka Iwama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/530,892

(22) Filed: Nov. 3, 2014

(65) Prior Publication Data

US 2015/0125169 A1 May 7, 2015

(30) Foreign Application Priority Data

Nov. 7, 2013 (JP) ..... 2013-231549

(51) Int. Cl.
*G03G 15/043* (2006.01)
*G03G 15/01* (2006.01)
*G03G 15/00* (2006.01)

(52) U.S. Cl.
CPC ..... *G03G 15/043* (2013.01); *G03G 15/0194* (2013.01); *G03G 15/5054* (2013.01); *G03G 2215/0161* (2013.01)

(58) Field of Classification Search
CPC ..... G03G 15/04072; G03G 2215/0158
See application file for complete search history.

(56) References Cited

U.S. PATENT DOCUMENTS

| | | | | |
|---|---|---|---|---|
| 5,768,655 | A * | 6/1998 | Yoshino et al. | 399/69 |
| 7,136,600 | B2 * | 11/2006 | Yamanaka et al. | 399/66 |
| 7,253,935 | B2 * | 8/2007 | Kobayashi | G02B 7/008 347/243 |
| 7,343,110 | B2 | 3/2008 | Sakamoto | |
| 2006/0029407 | A1 | 2/2006 | Sakamoto | |
| 2008/0225307 | A1 | 9/2008 | Murayama et al. | |

FOREIGN PATENT DOCUMENTS

| | | | |
|---|---|---|---|
| JP | 2003-207976 | A | 7/2003 |
| JP | 2005-234099 | A | 9/2005 |
| JP | 2006-039092 | A | 2/2006 |
| JP | 2006-047605 | A | 2/2006 |
| JP | 2007182018 | A * | 7/2007 |
| JP | 2008-225192 | A | 9/2008 |

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

In an image forming apparatus, an image forming device have an operating part and is configured to form an image at an image formation position on an imaging target. A control device is configured to control the image forming device to start performing an image forming process, determine an adjustment amount regarding the image formation position based on an operation amount of the operating part measured during a period of time from a first specified timing in a previous image forming process to a second specified timing in or before a current image forming process, and adjust, based on the adjustment amount, the image formation position where an image is formed pursuant to the current image forming process.

13 Claims, 7 Drawing Sheets

IMAGE FORMING APPARATUS PROVIDED WITH IMAGE FORMATION POSITION CORRECTION FUNCTION

CROSS REFERENCE TO RELATED APPLICATION

This application claims priority from Japanese Patent Application No. 2013-231549 filed Nov. 7, 2013. The entire content of the priority application is incorporated herein by reference.

TECHNICAL FIELD

The disclosure relates to a technique for correcting an image formation position for forming an image on a sheet.

BACKGROUND

One conventional image forming apparatus provided with a position correction function to correct an image formation position for forming an image on a sheet has the following structure (see Japanese Patent Application Publication No. 2008-225192). This conventional image forming apparatus has an image forming device, a conveying body, and a sensor. The image forming device forms a mark for position detection on the conveying body. The sensor detects the position of the mark. The image formation position is corrected based on the position of the detected mark.

SUMMARY

The image forming apparatus also has operating parts, such as a polygon mirror and a fixing unit, for example. The operation of the operating parts could generate heat, and the image formation position might be shifted by the effects of the heat. The degree of the effects of the heat during a current image forming process may be different from the degree of the effects of the heat during previous image forming processes. In such a case, if the current image forming process forms an image at the same image formation position as for the previous image forming processes, the image formation position could deviate from an ideal position.

In view of the foregoing, it is an object of the disclosure to provide a technique for preventing the accuracy of the image formation position from being decreased by the heat generated from the operating parts.

In order to attain the above and other objects, the disclosure provides an image forming apparatus including an image forming device, and a control device. The image forming device may have an operating part and be configured to form an image at an image formation position on an imaging target. The control device may be configured to control the image forming device to start performing an image forming process. The control device may be configured to determine an adjustment amount regarding the image formation position based on an operation amount of the operating part measured during a period of time from a first specified timing in a previous image forming process to a second specified timing in or before a current image forming process. The previous image forming process may be performed precedent to the current image forming process to form an image on an imaging target different from an imaging target on which the image is formed pursuant to the current image forming process. The control device may be configured to adjust, based on the adjustment amount, the image formation position where an image is formed pursuant to the current image forming process.

According to another aspect, the disclosure provides an image forming apparatus including a conveying body, an image forming device, a detector, and a control device. The conveying body may be configured to convey a sheet of paper. The image forming device may have an operating part and be configured to form an image at an image formation position on an imaging target and form a mark on the conveying body. The detector may be configured to detect the mark. The detector may output a signal when the mark is detected. The control device may be configured to control the detector to detect the mark. The control device may be configured to detect a mark formation position based on the signal outputted from the detector. The control device may be configured to determine an adjustment amount regarding the image formation position based on an operation amount of the operating part measured during a period of time from a first specified timing in a previous image forming process to a second specified timing in or before a current image forming process. The previous image forming process may be performed precedent to the current image forming process to form an image on an imaging target different from an imaging target on which the image is formed pursuant to the current image forming process. The control device may be configured to adjust the mark formation position based on the adjustment amount, and set an image formation position corresponding to the adjusted mark formation position to a current image formation position for the current image forming process.

According to still another aspect, the disclosure provides an image forming apparatus including a conveying body, an image forming device, a detector, and a control device. The conveying body may be configured to convey a sheet of paper. The image forming device may have an operation part and be configured to form an image at an image formation position on an imaging target and form a mark on the conveying body. The detector may be configured to detect the mark. The detector may output a signal when the mark is detected. The control device may be configured to selectively operate in one of a first mode and a second mode. In the first mode, the control device may operate to control the image forming device to start performing an image forming process. The control device may operate to determine an adjustment amount regarding the image formation position based on an operation amount of the operating part measured during a period of time from a first specified timing in a previous image forming process to a second specified timing in or before a current image forming process. The previous image forming process may be performed precedent to the current image forming process to form an image on an imaging target different from an imaging target on which the image is formed pursuant to the current image forming process. The control device may operate to adjust, based on the adjustment amount, the image formation position where an image is formed pursuant to the current image forming process. In the second mode, the control device may operate to control the detector to detect the mark. The control device may operate to detect a mark formation position based on the signal outputted form the detector. The control device may operate to determine an adjustment amount regarding the image formation position based on an operation amount of the operating part measured during a period of time from a first specified timing in a previous image forming process to a second specified timing in or before a current image forming process. The previous image forming process may be performed precedent to the current image forming process to form an image on an imaging target different from an imaging target on which the image is formed pursuant to the current image forming process. The control device may operate to adjust the mark formation position based on the adjustment amount, and set an image formation position corresponding to the adjusted mark formation position to a current image formation position for the current image forming process.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
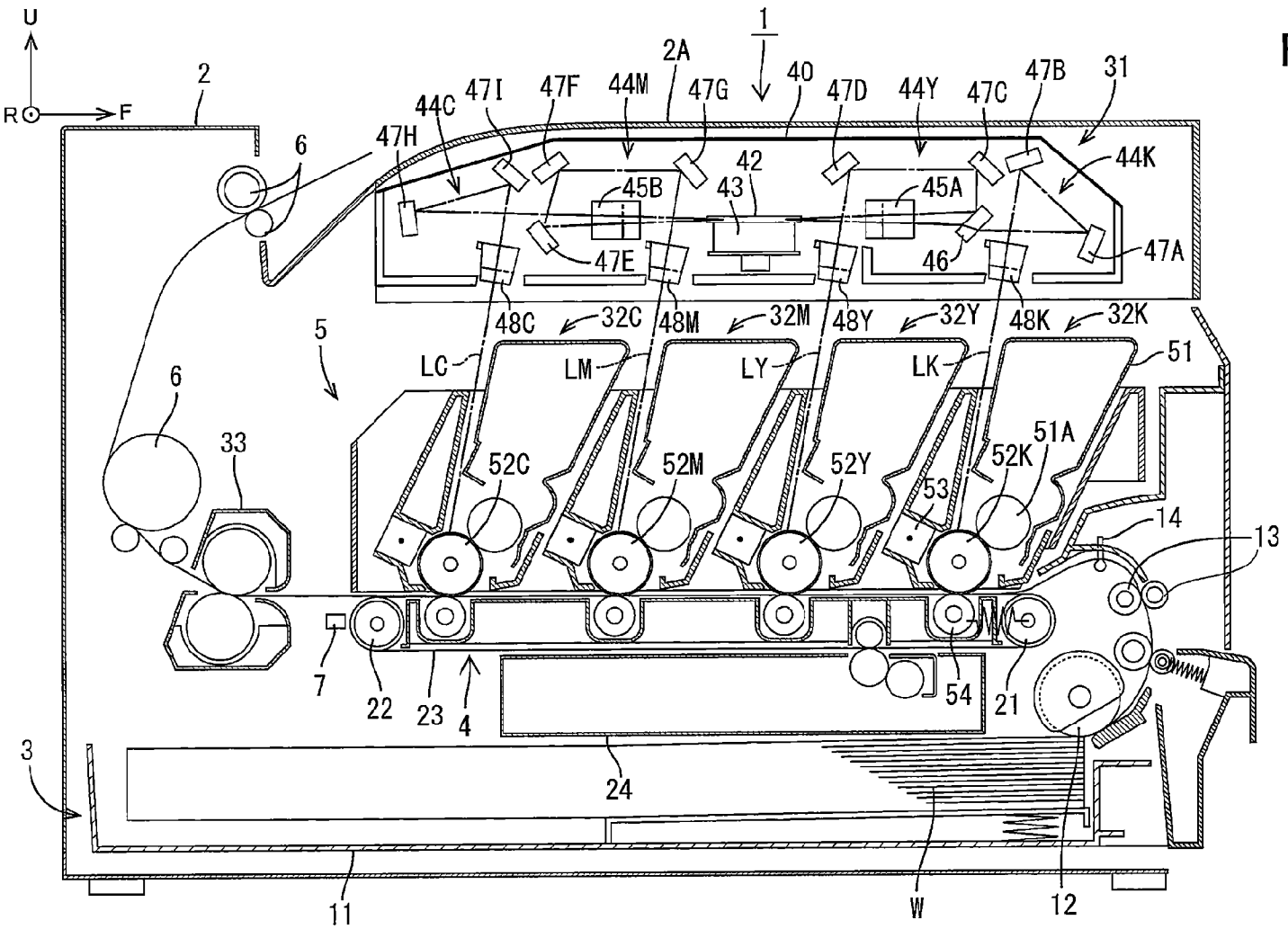
FIG. 1 is a schematic cross-sectional view illustrating a printer according to an embodiment of the disclosure.

A printer 1 according to one embodiment of the disclosure will be described while referring to FIGS. 1 to 7. The printer 1 is a color laser printer of a direct-transfer tandem type that forms in image using four colors (black, yellow, magenta, and cyan), for example. The printer 1 is an example of an image forming apparatus of the disclosure. In the description below, the right side of the paper surface of FIG. 1 is referred to as the front side F of the printer 1, the far side of the paper surface as the right side R of the printer 1, and the upper side of the paper surface as the upper side U of the printer 1, respectively. The components of terms of the printer 1 are sometimes classified by color; the reference symbols of those components and terms end with K (black), Y (yellow), M (magenta), or C (cyan), which indicates each of the colors. In FIG. 1, each color system has the same components, and the reference symbols of those components are sometimes omitted.

The printer 1 includes a main casing 2, a sheet supply unit 3, a belt unit 4, an image forming device 5, and a discharge roller 6. A discharge tray 2A is provided on an upper surface of the main casing 2.

The sheet supply unit 3 includes a supply tray 1, a feed roller 12, registration rollers 13, and a registration sensor 14. The supply tray 11 is provided in a bottom portion of the main casing 2. A plurality of sheets W can be stacked on the supply tray 11. The feed roller 12 feeds each of the sheets W in the supply tray 11 to the registration rollers 13.

The registration rollers 13 convey the sheet W to the belt unit 4, which is described later. The registration sensor 14 has a detection area between the registration rollers 13 and the belt unit 4. The registration sensor 14 outputs a detection signal indicating whether or not a sheet W exists in the detection area. The timing for starting to write an image to the sheet W is determined based on the timing at which the tip of the sheet W is detected by the registration sensor 14.

The belt unit 4 includes an endless belt 23, which is stretched between a support roller 21 and a drive roller 22. The belt 23 is an example of a conveying body. In the belt unit 4, the belt 23 is moved in a circulating manner in a counter-clockwise direction as shown in FIG. 1. The sheet W is electrostatically attracted to the upper surface of the belt 23, and is conveyed to a fixing unit 33 disposed in a rear side of the printer 1. Transfer rollers 43 are provided on the inner side of the belt 23. A cleaner 24 is provided below the belt unit 4 to collect toner and paper powder adhering to the surface of the belt 23.

The image forming device 5 includes a scanner 31, process units 32K to 32C, and the fixing unit 33.

The scanner 31 emits laser beams LK, LY, LM, and LC based on image data of each color to expose the surfaces of photosensitive drums 52K to 52C of each color. More specifically, the scanner 31 includes the following components in a box-shaped case 40: a light source 42 (see FIG. 3), a polygon mirror 42, a polygon motor 43, and optical systems 44K to 44C.

The light source 41 includes four laser emitting portions for each of the colors. The polygon mirror 42 is a rotating polygon mirror with a plurality of reflecting surfaces. The polygon mirror 42 is provided at almost the central position of the case 40 in such a way as to be rotatable around an axis that extends in a vertical direction. In this embodiment, the polygon mirror 42 has six reflecting surfaces. The polygon motor 43 is an example of an operating part. The polygon motor 43 drives to rotate the polygon mirror 42.

The laser emitting portion for black emits a laser beam LK that is modulated based on black image data. The polygon mirror 42 has one reflecting surface that reflects the laser beam LK to the front side. The black optical system 44K guides the laser beam LK reflected by the polygon mirror 42 to the photosensitive drum 52K for black. More specifically, in the black optical system 44K, the laser beam LK passes through a first scanning lens 45A and a half mirror 46, and travels downward after being reflected by reflecting mirrors 47A and 47B. Then, the laser beam LK passes through a second scanning lens 48K, and irradiates the surface of the black photosensitive drum 52K.

The laser emitting portion for yellow emits a laser beam LY that is modulated based on yellow image data. The polygon mirror 42 has one reflecting surface that reflects the laser beam LY to the front side. The yellow optical system 44Y guides the laser beam LY reflected by the polygon mirror 42 to the photosensitive drum 52Y for yellow. More specifically, in the yellow optical system 44Y, the laser beam LY passes through a first scanning lens 45A, and travels downward after being reflected by the half mirror 46 and reflecting mirrors 47C and 47D. Then, the laser beam LY passes through a second scanning lens 48Y, and irradiates the surface of the yellow photosensitive drum 52Y.

The laser emitting portion for magenta emits a laser beam LM that is modulated based on magenta image data. The polygon mirror 42 has one reflecting surface that reflects the laser beam LM to the rear side. The magenta optical system 44M guides the laser beam LM reflected by the polygon mirror 42 to the photosensitive drum 52M for magenta. More specifically, in the magenta optical system 44M, the laser beam LM passes through a first scanning lens 45B, and travels downward after being reflected by reflecting mirrors 47E, 47F, and 47G. Then, the laser beam LM passes through a second scanning lens 48M, and irradiates the surface of the magenta photosensitive drum 52M.

The laser emitting portion for cyan emits a laser beam LC that is modulated based on cyan image data. The polygon mirror 42 has one reflecting surface that reflects the laser beam LC to the rear side. The cyan optical system 44C guides the laser beam LC reflected by the polygon mirror 42 to the photosensitive drum 52C for cyan. More specifically, in the cyan optical system 44C, the laser beam LC passes through the first scanning lens 45B, and travels downward after being reflected by reflecting mirrors 47H and 47I. Then, the laser beam LC passes through a second scanning lens 48C, and irradiates the surface of the cyan photosensitive drum 52C.

As the polygon mirror 42 is rotated, the scanning of the laser beams LK to LC, which correspond to each of the colors, is carried out for each line in a left-right direction on the surfaces of the photosensitive drums 52K to 52C, which correspond to each of the colors. In this manner, the photosensitive drums 52K to 52C are exposed. The first scanning lenses 45A and 45B are converging lenses such as fθ lenses, for example. The first scanning lenses 45A and 45B are disposed in such a way as to face each other across the polygon mirror 42. The four second scanning lenses 48K to 48C are arranged in a direction in which the belt 23 conveys the sheets. The second scanning lenses 48K to 48C are toric lenses, for example.

In this case, the yellow and magenta optical systems 44Y and 44M, as a whole, are disposed closer to the polygon motor 43 than the black and cyan optical systems 44K and 44C. Accordingly, it is more likely that the yellow and magenta optical systems 44Y and 44M will significantly deform or deviate due to the effects of the heat generated by rotation of polygon motor 43. The black and cyan optical systems 44K and 44C are an example of first optical systems. The yellow and magenta optical systems 44Y and 44M are an example of second optical systems.

The process unit 32K for black includes a developing section 51, the photosensitive drum 52K, a charger 53, and a transfer roller 54. The developing section 51 includes a developing roller 51A to supply black toner to the surface of the photosensitive drum 52K.

The surface of the photosensitive drum 52K is charged by the charger 53. The charged area of the photosensitive drum 52K is exposed by scanning of the laser beam LK by the scanner 31. As a result, an electrostatic latent image is formed on the surface of the photosensitive drum 52K. Then, the toner is supplied from the developing section 51 to the electrostatic latent image to form a black toner image on the photosensitive drum 52K.

The toner image carried on the photosensitive drum 52K is transferred to the belt 23 or to a sheet W on the belt 23, between the photosensitive drum 52K and the transfer roller 54K. The yellow, magenta, and cyan process units 32Y to 32C have the same configuration as the black process unit 32K except for the color of the toner. Therefore, the specific configuration of the yellow, magenta, and cyan process units 32Y to 32C will not be described. The photosensitive drums 52K to 52C are an example of photosensitive bodies.

The sheet W to which the toner images of each of the colors have been transferred is then conveyed to the fixing unit 33. The fixing unit 33 thermally fixes the toner images, which have been transferred onto the sheet W to the surface of the paper. After passing through the fixing unit 33, the sheet W is conveyed upward by the discharge roller 6, and is then discharged onto the discharge tray 2A.

Figure 2:
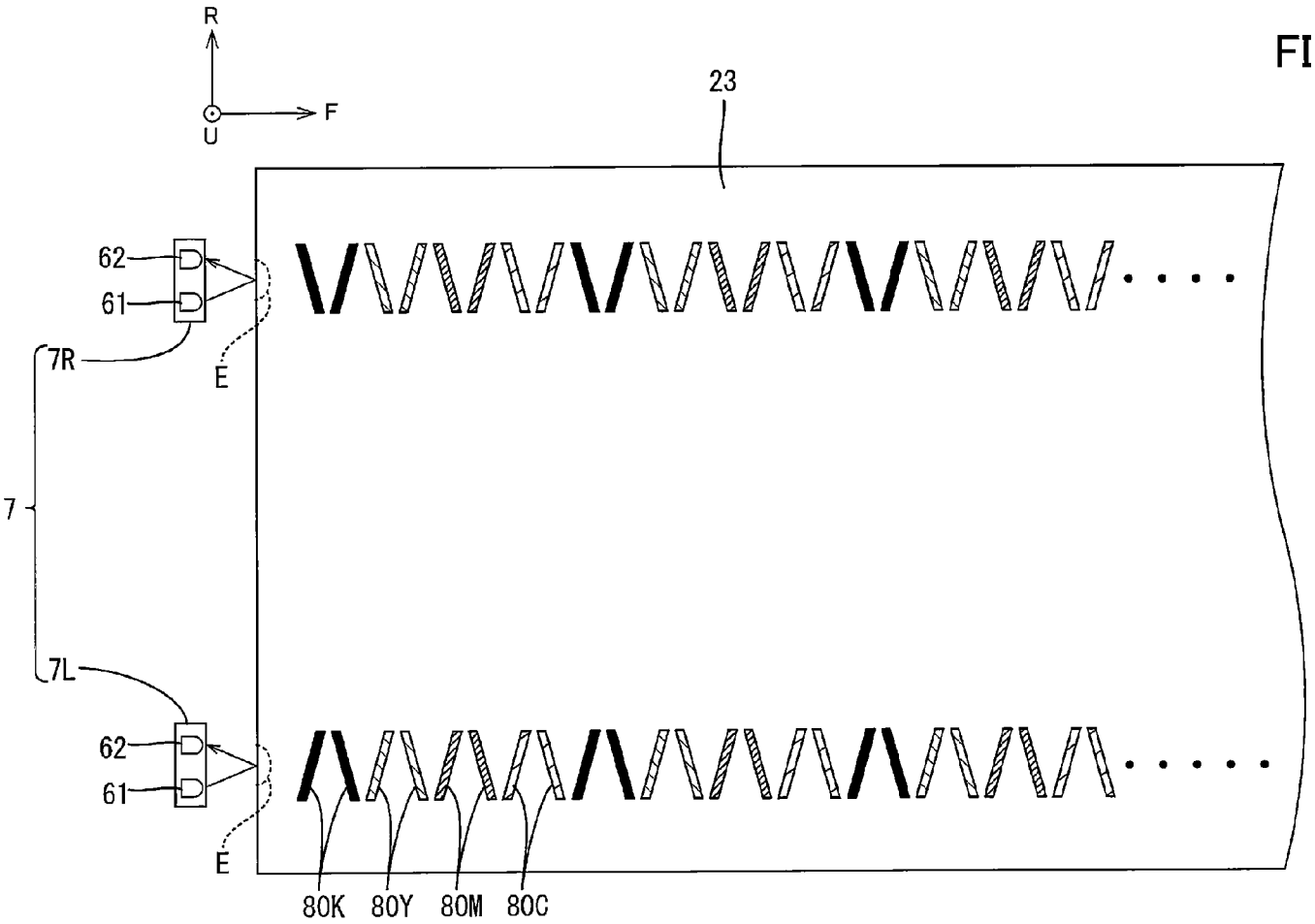
FIG. 2 is an explanatory diagram showing an example of a layout of a mark sensor and marks for deviation detection.

The printer 1 further includes a mark sensor 7. The mark sensor 7 is an example of a detector. The mark sensor 7 outputs a detection signal indicating whether or not marks 80 exist on the belt 23. More specifically, as shown in FIG. 2, the mark sensor 7 includes a sensor 7R and a sensor 7L. The sensor 7R is disposed on the right side of a width direction of the belt 23 or of the left-right direction of FIG. 2, and the sensor 7L is disposed on the left side.

Each of the sensors 7R and 7L is a reflective optical sensor that includes a light emitting element 61, such as LED, and a light receiving element 62, such as a phototransistor. The mark sensor 7 is formed in such a way that the light emitting element 61 emits a beam to a detection area E of the surface of the belt 23, and the light receiving element 62 receives the beam from the detection area E. The mark sensor 7 outputs a detection signal based on a difference in the amount of light received by the light receiving element 62 between the case where the marks 80 exist within the detection area E and the case where the marks 80 do not exist within the detection area E. The marks 80 are formed by the process units 32K to 32C and transferred onto the belt 23.

Figure 3:
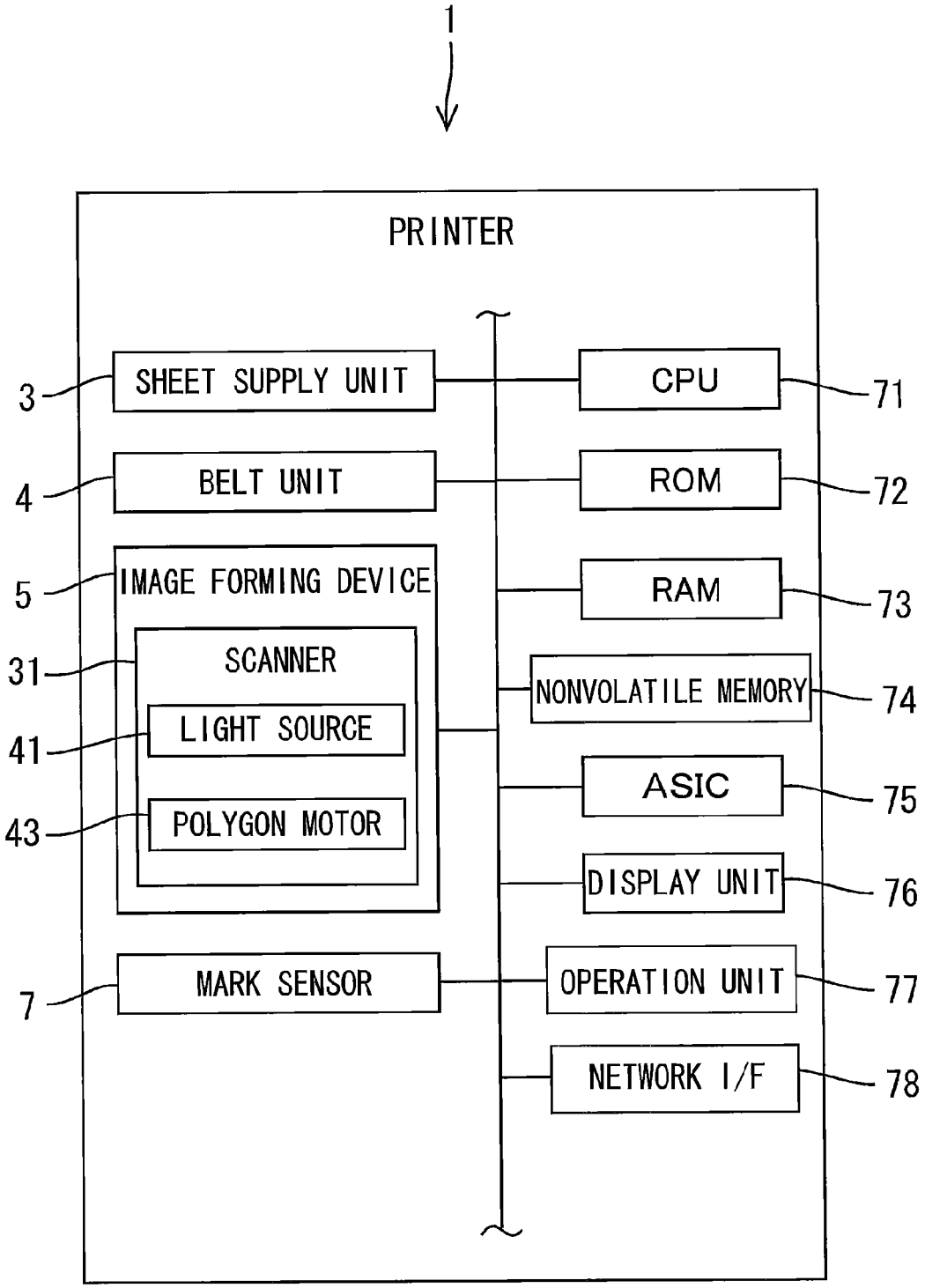
FIG. 3 is a block diagram showing an electrical configuration of the printer.

As shown in FIG. 3, the printer 1 includes a central processing unit (referred to as CPU, hereinafter) 71, a ROM 72, a RAM 73, a nonvolatile memory 74, an ASIC (Application Specific Integrated Circuit) 75, a display unit 76, an operation unit 77, and a network interface 78, in addition to the above-described sheet supply unit 3, belt unit 4, image forming device 5, and mark sensor 7.

ROM 72 stores various programs. The various programs include, for example, a program for executing a print process (described later), and a program for controlling operation of each part of the printer 1, such as the image forming device 5. The RAM 73 works as a work area when the CPU 71 executes the various programs, and as a temporary data storage area.

The nonvolatile memory 74 previously stores an elapsed time table and a coefficient table which are described later. The nonvolatile memory 74 may be a rewritable memory, such as NAVRAM, flash memory, HDD, EPPROM, and the like.

The CPU 71 is an example of a control device. The CPU 71 is connected to the ROM 72, the RAM 73, and other components. The CPU 71 controls each part of the printer 1 in accordance with programs read from the ROM 72. The display unit 76 includes a liquid crystal display and lamps, and displays various setting screens and the operation status of the device. The operation unit 77 includes a plurality of buttons, and receives various commands input by a user. The network interface 78 is an interface that uses a wireless communication method or a wired communication method to communicate with an external device (not shown).

Next, a control operation executed by the CPU 71 will be described with reference to FIGS. 4 to 7. On the graph of FIG. 5, an open circle means that an image is formed on one sheet W.

After the printer 1 is turned ON, the CPU 71 determines whether or not the conditions for starting to print one sheet are satisfied. The print start conditions include, for example, the receipt of a print command from a user through the operation unit 77, the receipt of a print command from an external device through the network interface 78, the completion of an image forming process on a previous sheet W, and the completion of a deviation acquisition process (described later). If the CPU 71 determines that the print start conditions are not satisfied, the CPU 71 enters a standby mode. After having determined that the print start conditions are satisfied, the CPU 71 starts a print process shown in FIG. 4.

The polygon motor 43 generates the amount of heat that varies according to the number of times the polygon motor 43 is rotated between the previous image forming process and the current image forming process. The temperature inside the scanner 31 rises or falls depending on the amount of heat generated, possibly leading to a deformation or deviation of the optical systems 44. As a result, if the current image forming process forms an image at the same image formation position as for the previous image forming process, the image formation position could deviate from an ideal image formation position. The print process is a process of preventing the accuracy of the image formation position from being decreased by the heat generated from the polygon motor 43 when forming an image on the sheet W.

As for the deviation of the image formation position, there are deviations in both a main scanning direction and a sub-scanning direction. In the description below, however, assume that, during the print process, the printer 1 makes adjustments to the image formation position in the main scanning direction, based on an adjustment amount, and that the printer 1 does not make adjustments to the image formation position in the sub-scanning direction, based on an adjustment amount. Moreover, the deviation of the image formation position means a deviation of a correction-color image formation position relative to a reference-color image formation position, or color deviation; the reference color is black, and the correction colors are yellow, magenta, and cyan.

The CPU 71 first determines an adjustment amount for each of the correction colors based on the number of times the polygon motor 43 is rotated during an elapsed time ΔT between the previous image forming process and the current image forming process (S1 to S9). The adjustment amount for each of the correction colors is an amount by which the deviation of the image formation position caused by the heat from the polygon motor 43 during the elapsed time is offset. The processes of S1 to S9 are an example of determining an adjustment amount, hereinafter, referred to as a determination process.

More specifically, the CPU 71 determines the adjustment amount based on the result of multiplying the elapsed time ΔT by a deviation prediction coefficient F during the determination process; the deviation prediction coefficient F is determined based on a unit rotation amount, which is the number of times the polygon motor 43 is rotated per unit time in the elapsed time ΔT.

The deviation prediction coefficient F represents the deviation of the image formation position per unit time caused by the heat from the polygon motor 43. Hereinafter, that deviation is referred to as a heat-induced unit deviation. As the unit rotation amount of the polygon motor 43 per unit time rises, the amount of heat generated from the polygon motor 43 becomes larger accordingly, and the heat-induced unit deviation is therefore likely to increase. Consequently, the deviation prediction coefficient F is set to a larger value. The unit rotation amount is an example of a unit operation amount, and the deviation prediction coefficient F is an example of a coefficient.

More specifically, the CPU 71 confirms whether an operating range of the unit rotation amount of the polygon motor 43 is within a high-speed range, a medium-speed range, or a low-speed range (S1). Here, the unit rotation amount of the polygon motor 43 is substantially correlated with the number of sheets W printed per unit time. Hereinafter, the number of sheets printed per unit time is simply referred to as a unit printed sheet number. The high-speed range is a range for the unit printed sheet number when the polygon motor 43 is continuously driven and rotated; the high-speed range covers 10 pages per minute, or more, for example. As in the case of a high-speed forming period of FIG. 5, for example, if the image forming device 5 sequentially forms images on a plurality of sheets W at short intervals ΔT1, the unit rotation amount of the polygon motor 43 is within the high-speed range.

The low-speed range is a range for the unit printed sheet number when the polygon motor 43 is driven and rotated intermittently at relatively long intervals. The unit printed sheet number of the low-speed range is less than that of the high-speed range; the low-speed range covers one page per minute, or less, for example. As in the case of a low-speed forming period of FIG. 5, for example, if the image forming device 5 starts to form an image on a sheet W after being in a standby mode for a relatively long time ΔT3, the unit rotation amount of the polygon motor 43 is within the low-speed range.

The medium-speed range is a range for the unit printed sheet number when the polygon motor 43 is driven and rotated intermittently at relatively short intervals. The unit printed sheet number of the medium-speed rage is between those of the high-speed range and the low-speed range; the medium-speed range covers two to nine pages per minute, for example. As in the case of a medium-speed forming period of FIG. 5, for example, if the image forming device 5 starts to form an image on a sheet W after being in a standby mode for a time ΔT2 that is shorter than the time ΔT3, the unit rotation amount of the polygon motor 43 is within the medium-speed range.

For example, the CPU 71 can confirm an operating range of the polygon motor 43 based on the elapsed time ΔT elapsed after the previous image forming process and before the current process of printing on a sheet W starts. The elapsed time ΔT represents the distance between the sheets W sequentially conveyed by the belt unit 4, or sheet distance. The unit printed sheet number and the unit rotation amount can be estimated based on the sheet distance.

Figure 5:
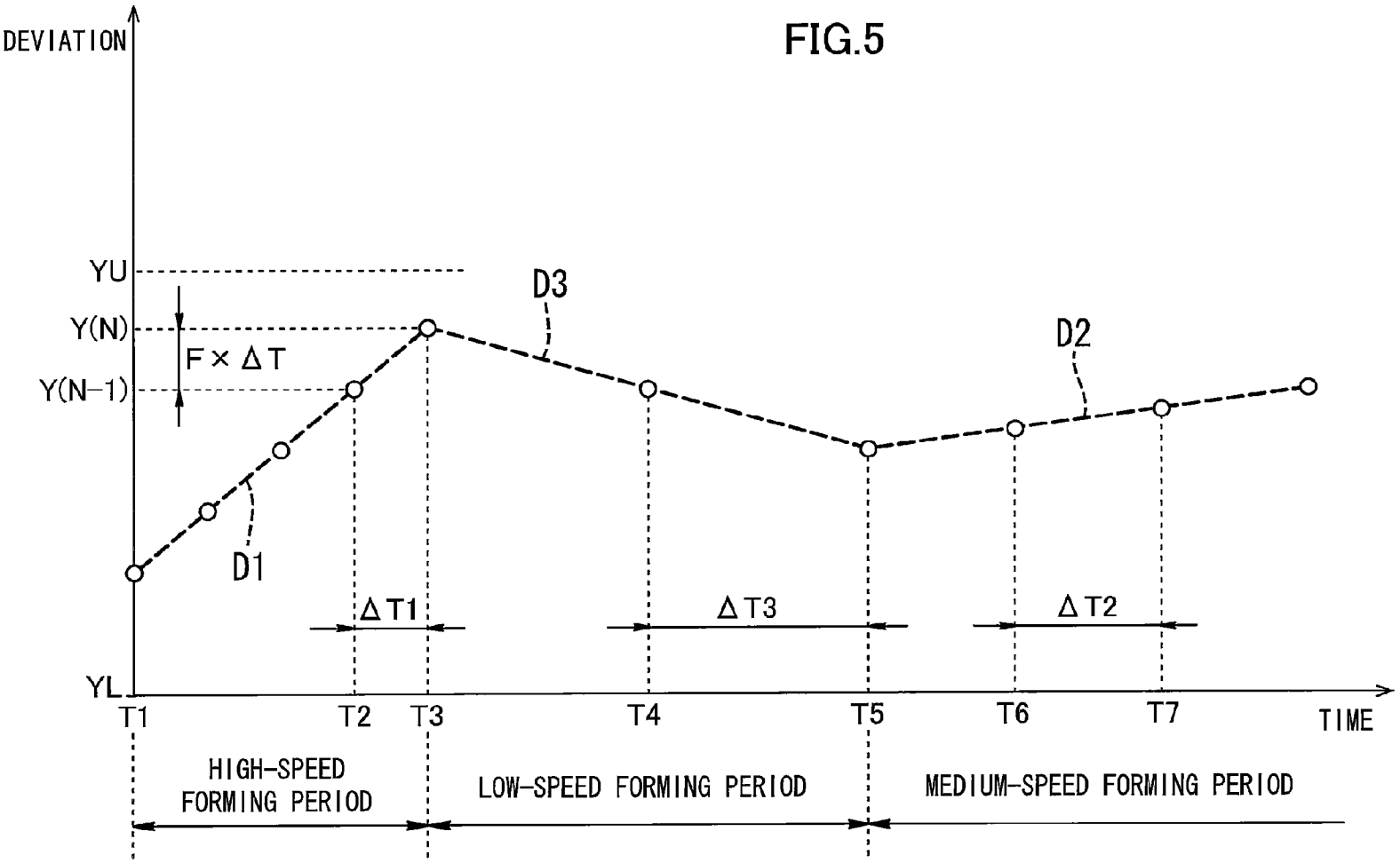
FIG. 5 is a graph showing a relation between deviation amounts and image-forming speed.

As in the case of the high-speed forming period of FIG. 5, for example, if the elapsed time ΔT is relatively short, the unit rotation amount of the polygon motor 43 is relatively large and is therefore likely to be within the high-speed range. As in the case of the low-speed forming period of FIG. 5, on the other hand, if the elapsed time ΔT is relatively long, the unit rotation amount of the polygon motor 43 is relatively small and is therefore likely to be within the low-speed range. In this manner, the CPU 71 can confirm the operating range of the polygon motor 43 based on whether the elapsed time ΔT is short or long. The previous image forming process includes both a process of forming a mark (described later) and a process of forming an image on a sheet W.

The CPU 71 measures the elapsed time ΔT as described below. While the printer 1 is ON, the CPU 71 constantly measures the time. At a time when the process of forming an image on a sheet W ends in S11 (described later) or when the process of forming a mark ends in S21 of FIG. 6, the CPU 71 resets the measured time to zero before starting to measure again. In S1, the CPU 71 reads the time measured so far, thereby acquiring the elapsed time ΔT elapsed after the previous image forming process and before the current process of forming an image on a sheet W starts. An elapsed time table is previously stored in the nonvolatile memory 74; the elapsed time table shows the relation between the ranges of elapsed time ΔT and the operating ranges. The CPU 71 confirms the operating range of the polygon motor 43 based on the acquired elapsed time ΔT and the elapsed time table.

In S2, the CPU 71 chooses a coefficient D corresponding to the confirmed operating range. More specifically, a coefficient table is previously stored in the nonvolatile memory 74 for each of the correction colors; the coefficient table shows the relation between the operating ranges and coefficients D1, D2, and D3. The CPU 71 refers the coefficient table and chooses a high-speed coefficient D1 if the confirmed operating range is the high-speed range. The CPU 71 chooses a medium-speed coefficient D2 if the confirmed operating range is the medium-speed range. The CPU 71 chooses a low-speed coefficient D3 if the confirmed operating range is the low-speed range. The high-speed coefficient D1, the medium-speed coefficient D2, and the low-speed coefficient D3 have the following magnitude relationship: D1>D2>D3. Hereinafter, suppose that the values of D1 and D2 are positive, and the value of D3 is negative.

In FIG. 5, the high-speed coefficient D1 represents a slope of the graph during the high-speed forming period. The medium-speed coefficient D2 represents a slope of the graph during the medium-speed forming period. The low-speed coefficient D3 represents a slope of the graph during the low-speed forming period. In this manner, the negative coefficient D3 is used as well as the positive coefficients D1 and D2. Therefore, the printer 1 can prevent the accuracy of the image formation position from being decreased not only when the deviation of the image formation position increases due to a rise in the amount of heat generated from the polygon motor 43, but also when the deviation of the image formation position decreases due to a drop in the amount of heat generated from the polygon motor 43. The coefficients D1, D2, and D3 may be determined through an experiment of actually operating the printer 1 to obtain the deviations, for example.

In this case, the optical systems 44 that are disposed near the polygon motor 43 are more likely to be significantly deformed or displaced due to the effects of the heat from the polygon motor 43, possibly leading to a larger deviation of the image formation position. As described above, the yellow and magenta optical systems 44Y and 44M, as a whole, are disposed closer to the polygon motor 43 than the cyan optical system 44C. Accordingly, the coefficients D1, D2, and D3 for yellow and magenta are set greater than the coefficients D1, D2, and D3 for cyan.

Therefore, when the yellow and magenta optical systems 44Y and 44M are used to form an image on a sheet W, the adjustment amounts are larger than when the cyan optical system 44C is used to form an image on a sheet W. In this manner, the printer 1 can prevent the accuracy of the image formation position from being decreased due to a difference in the distance from the polygon motor 43 to the optical system 44. The yellow and magenta optical systems 44Y and 44M are at the same distance from the polygon motor 43; the coefficients D1, D2, and D3 for yellow and magenta are therefore equal.

In S3, the CPU 71 determines whether or not the conveying speed of a sheet W is high. If the sheet W is plain paper, for example, the CPU 71 drives and rotates the belt unit 4 at high speed to carry the sheet W. The conveying speed at this time is an example of a first conveying speed. If the sheet W is thick paper, for example, the CPU 71 drives and rotates the belt unit 4 at low speed to carry the sheet W, thereby ensuring that a toner image is thermally fixed to the thick paper. The conveying speed at this time is an example of a second conveying speed.

After determining that the conveying speed of the sheet W is high (S3: YES), the CPU 71 determines to use the coefficients D1, D2, and D3 chosen in S2 as the deviation prediction coefficients F without any change (S7). If the CPU 71 determines that the conveying speed of the sheet W is low (S3: NO), then the CPU 71 determines whether or not the rotation speed of the polygon motor 43 is high (S4).

If the CPU 71 has not accepted a quiet mode from a user through the operation unit 77, for example, the CPU 71 drives and rotates the polygon motor 43 at high speed. The rotation speed of the polygon motor 43 at this time is an example of a first rotation speed. If the CPU 71 has accepted the quiet mode specified, the CPU 71 drives and rotates the polygon motor 43 at low speed. The rotation speed of the polygon motor 43 at this time is an example of a second rotation speed.

After determining that the conveying speed of the sheet W is not high (S3: NO) and that the rotation speed of the polygon motor 43 is high (S4: YES), the CPU 71 proceeds to S5. In this case, the amount of heat generated from the polygon motor 43 during the process of forming an image on one sheet W when the conveying speed of the sheet W is low (S3: NO) is larger than when the conveying speed of the sheet W is high (S3: YES). Accordingly, the deviation of the image formation position is likely to increase.

In S5, the CPU 71 changes the coefficients D1, D2, and D3 chosen in S2 to larger values by adding a predetermined value or by multiplying the coefficients D1 and D2 by a value greater than one and multiplying the coefficient D3 by a value that is greater than or equal to zero and less than one, and the CPU 71 determines to use the changed values as the deviation prediction coefficients F (S7). As a result, the deviation prediction coefficient F when an image is formed on a sheet W being conveyed at low speed and the deviation prediction coefficient F when an image is formed on a sheet W being conveyed at high speed are different from each other and determined as appropriate values. In this manner, the printer 1 can prevent the accuracy of the image formation position from being decreased due to a difference in the conveying speed of the sheet W.

In S4, after determining that the rotation speed of the polygon motor 43 is not high (S4: NO), the CPU 71 proceeds to S6. When the rotation speed of the polygon motor 43 is low (S4: NO), the amount of heat generated from the polygon motor 43 during the process of forming an image on one sheet W is smaller than when the rotation speed of the polygon motor 43 is high (S4: YES). Accordingly, the deviation of the image formation position is likely to decrease.

In S6, the CPU 71 therefore changes the coefficients D1, D2, and D3 chosen in S2 to smaller values by subtracting a predetermined value or by dividing the coefficients D1 and D2 by a value greater than one and dividing the coefficient D3 by a value that is greater than or equal to zero and less than one, and the CPU 71 determines to use the changed values as the deviation prediction coefficients F (S7). As a result, the deviation prediction coefficient F when the polygon motor 43 is rotated at low speed to form an image on a sheet W and the deviation prediction coefficient F when the polygon motor 43 is rotated at high speed to form an image on a sheet W are different from each other and determined as appropriate values. In this manner, the printer 1 can prevent the accuracy of the image formation position form being decreased due to a difference in the rotation speed of the polygon motor 43.

In S8, the CPU 71 calculates, for each of the correction colors, a color deviation prediction amount Y(N) for the current process, or a current color deviation prediction amount Y(N). The current color deviation prediction amount Y(N) is a predicted amount of the deviation of the image formation position in the run-up to the current image forming process, and is calculated according to the following formula:

$$Y(N)=Y(N-1)+F\times\Delta T.$$

In this formula, Y(N−1) represents a color deviation prediction amount for the previous process, or a previous color deviation prediction amount; F×ΔT represents a predicted amount of the deviation caused by the heat between the previous image forming process and the current image forming process.

In S9, the CPU 71 executes an upper limit/lower limit process for each of the correction colors. More specifically, if the current color deviation prediction amount Y(N) calculated in S8 is less than or equal to a predetermined upper-limit amount YU and greater than or equal to a lower-limit amount YL, the CPU 71 does not change the color deviation prediction amount Y(N) for the current process. If the color deviation prediction amount Y(N) for the current process is greater than the upper-limit amount YU, the CPU 71 changes the current color deviation prediction amount Y(N) to the upper-limit amount YU. If the color deviation prediction amount Y(N) for the current process is less than the lower-limit amount YL, the CPU 71 changes the current color deviation prediction amount Y(N) to the lower-limit amount YL.

In FIG. 5, for example, if the high-speed forming period further continues after time T3, and if the current color deviation prediction amount Y(N) calculated in S8 exceeds the upper-limit amount YU, the current color deviation prediction amount Y(N) is changed to the upper-limit amount YU. This configuration prevents the image formation position from being corrected to a position that does not reflect an actual deviation at all. The range that is less than or equal to the upper-limit amount YU and greater than or equal to the lower-limit amount YL is an example of a specified range. The upper-limit amount YU may be derived through an experiment of measuring the deviation at a time when a maximum temperature in the scanner 31 is recorded as the polygon motor 43 is being rotated. The lower-limit amount YL may be derived through an experiment of measuring the deviation at a time when a minimum temperature of the scanner 31 is recorded, or at room temperature, for example.

In S10, the CPU 71 calculates a correction amount YR for each of the correction colors. The correction amount YR is an amount by which the deviation calculated according to the following formula is offset:

$$\text{Deviation}=Y(N)-YW.$$

Here, YW is the deviation acquired by a previous deviation acquisition process (described later), and will be referred to as an acquired deviation amount YW.

In S11, the CPU 71 controls the image forming device 5 to form an image on a sheet W for each of the correction colors: the image forming device 5 forms the image at an image formation position in the main scanning direction that is adjusted by the correction amount YR calculated in S10 and at an image formation position in the sub-scanning direction that is based on a deviation amount acquired by the previous deviation acquisition process. The CPU 71 adjusts the image formation position by properly changing process conditions for the correction colors, such as the exposure timing, the speed of the belt unit 4 or photosensitive drums 52, and the like, for example. The process of S11 is an example of adjusting the image formation position, hereinafter, referred to as an adjustment process. This configuration prevents the accuracy of the image formation position from being decreased by the heat from the polygon motor 43, when forming an image on the sheet W.

Then, in S12, the CPU 71 performs an update process. More specifically, the CPU 71 sets the current color deviation prediction amount Y(N) as a previous color deviation prediction amount Y(N−1) to store in the nonvolatile memory 74. The CPU 71 also initializes the measured time to zero, starts measuring time again from zero, and then ends the current print process. After the current print process comes to an end, the CPU 71 will restart the print process shown in FIG. 4 if the CPU 71 determines that the conditions for starting to print the next sheet W are satisfied.

When the printer 1 is ON, the CPU 71 determines whether or not deviation acquisition conditions are satisfied. The deviation acquisition conditions are satisfied, for example, when the number of sheets W printed since the execution of the previous deviation acquisition process has reached a specified number, or when the period of time during which the printer 1 is ON reaches a specified time. If the CPU 71 determines that the deviation acquisition conditions are not satisfied, the CPU 71 enters a standby mode. After determining that the deviation acquisition conditions are satisfied, the CPU 71 starts a deviation acquisition process shown in FIG. 6. Hereinafter, the same steps as those in the print process of FIG. 4 will be represented by the same reference symbols to avoid duplicating description.

The CPU 71 first carries out the above-described processes of S1 to S10. However, the CPU 71 does not perform the processes S3 to S6, which are associated with the changing of the coefficients D. The reason is that, in forming the marks 80 (described later), the printer 1 constantly keeps both the conveying speed of the sheet W and the rotation speed of the polygon motor 43 high.

In S21, the CPU 71 controls the image forming device 5 to form a mark 80 for position correction on the belt 23: the image forming device 5 forms the mark 80 at an image formation position that is adjusted by the correction amount YR calculated in S10. More specifically, as shown in FIG. 2, the image forming device 5 forms patterns for position deviation correction on both ends of the belt 23, or at positions that pass through the detection areas E of the sensors 7R and 7L. Each of the patterns is a group of black marks 80K, yellow marks 80Y, magenta marks 80M, and cyan marks 80C that are arranged in the sub-scanning direction. Each of the marks 80 is a pair of rod-shaped marks, with at least one mark inclined at a predetermined angle to the main scanning direction.

After starting to form the marks 80, in S22, the CPU 71 detects the positions of rod-shaped marks of each-color marks 80 based on detection signals from the mark sensor 7. The process of S22 is an example of detecting a mark formation position. The CPU 71 recognizes a central position of a pair of rod-shaped marks of each mark 80 as a sub-scanning-direction position of the mark 80; the CPU 71 then calculates the distance between the reference-color mark 80K and each of the correction-color marks 80Y, 80M, and 80C in the sub-scanning direction. The distance between the reference-color mark and each of the correction-color marks varies according to the color deviation in the sub-scanning direction. Accordingly, the CPU 71 can acquire the color deviation in the sub-scanning direction for each of the correction colors.

Moreover, the CPU 71 calculates the gap between the paired rod-shaped marks formed on the right and left end portions of the belt 23 and the CPU 71 calculates a difference between the rod-shaped-mark gap for the reference-color mark 80K and the rod-shaped-mark gap for each of the correction-color marks 80Y, 80M, and 80C. The difference between the rod-shaped-mark gaps varies according to the color deviation in the main scanning direction. Accordingly, the CPU 71 can acquire the color deviation in the main scanning direction for each of the correction colors. After passing through the detection areas E, the marks 80 are collected by the cleaner 24.

Figure 4:
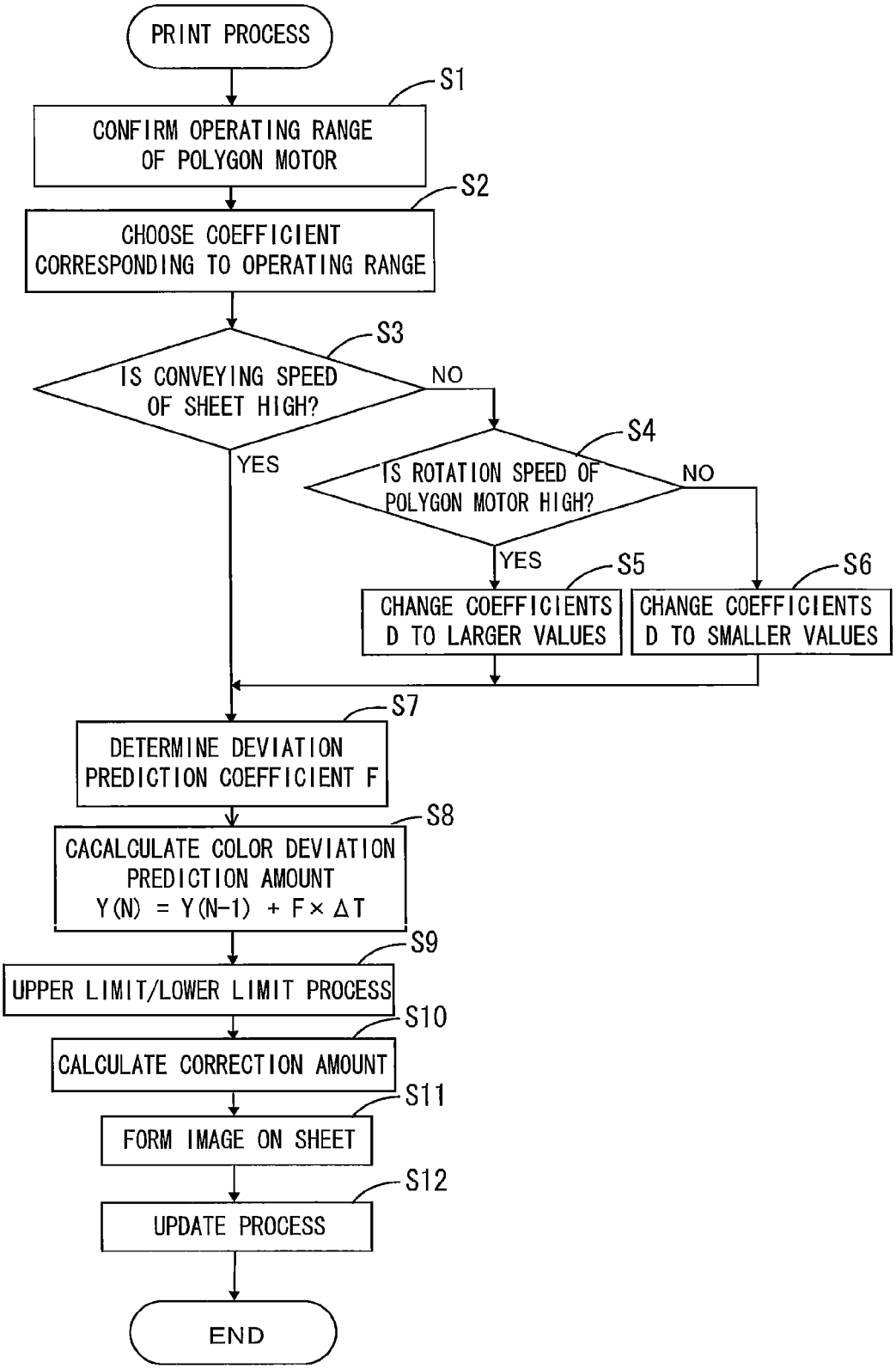
FIG. 4 is a flowchart illustrating steps in a print process.

In S23, the CPU 71 sets the color deviation in the main scanning direction acquired in S22 as an acquired deviation amount YW, which is used in S10 of FIG. 4, and stores the acquired deviation amount YW in the nonvolatile memory 74. In this manner, the acquired deviation amount YW is updated to the latest color deviation. Next, the CPU 71 performs an update process (S24), and ends the deviation acquisition process. More specifically, the CPU 71 sets the color deviation in the main scanning direction acquired in S22 as a previous color deviation prediction amount Y(N−1) to store in the nonvolatile memory 74. That is, the CPU 71 sets the acquired deviation amount YW, which is acquired from the actually detected results of the marks 80, as the previous color deviation prediction amount Y(N−1) instead of the color deviation prediction amount Y(N) calculated in S1 to S10.

Accordingly, in S8 of the first print process that follows the execution of the deviation acquisition process, the CPU 71 adjusts, based on the adjustment amount, the image formation position that is based on the actually acquired deviation amount YM, instead of the image formation position that is based on the previous color deviation prediction amount. As a result, the image formation position for the previous process is changed to a relatively accurate image formation position corresponding to the positions of the marks. This configuration prevents adjustment errors and other errors accumulated in the previous processes from increasing the deviation of the image formation position.

Figure 7:
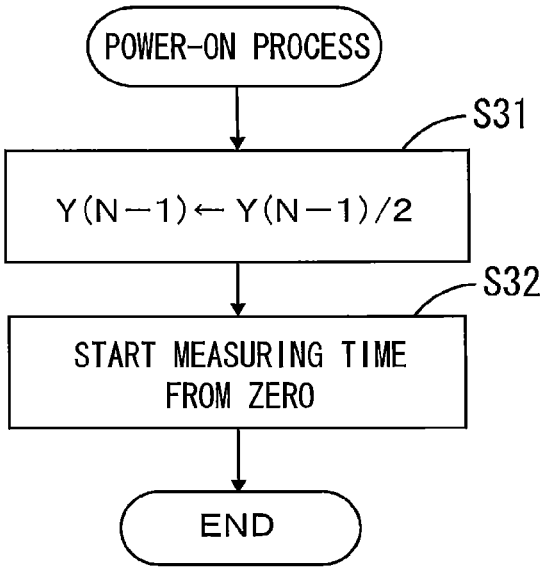
FIG. 7 is a flowchart illustrating steps in a power-on process.

After the printer 1 is turned ON, the CPU 71 performs a power-on process shown in FIG. 7. The CPU 71 changes the previous color deviation prediction amount Y(N−1) stored in the nonvolatile memory 74 to Y(N−1)/2 (S31). The CPU 71 initializes the measured time to zero and starts measuring the time again from zero (S32). Then the CPU 71 ends the power-on process.

In this case, the elapsed time ΔT is measured with the use of a counter storage area on the RAM 73. Therefore, once the printer 1 is turned OFF, the measured time is cleared. After then, when the printer 1 is turned ON, the measuring of time starts again from zero. If the printer 1 is turned OFF right before T5 in FIG. 5, for example, and then the printer 1 is promptly turned ON, the elapsed time ΔT should be ΔT3, but may be changed to a value close to ΔT1 after the printer 1 is turned ON.

As a result, the CPU 71 may mistake the range for the high-speed range in S2 of FIG. 4. Accordingly, the CPU 71 changes the previous color deviation prediction amount Y(N−1) to Y(N−1)/2, before calculating the color deviation prediction amount Y(N) in S8. This configuration prevents the correction amount YR from significantly deviating from its true value even as the printer 1 is turned OFF. While the CPU 71 changes the previous color deviation amount Y(N−1) to Y(N−1)/2 in S31, all that is required for the CPU 71 in S31 is to change the previous color deviation prediction amount Y(N−1) to a value smaller than Y(N−1).

According to the present embodiment described above, the deviation of the image formation position caused by the heat generated from the polygon motor during a period of time from the previous image forming process to the start of the current image forming process can be predicted from the rotation amount of the polygon motor during the period. Therefore, according to the present embodiment, an adjustment amount is determined based on the rotation amount of the polygon motor 43 during the period, the image formation position for the previous process is adjusted based on the adjustment amount, and the adjusted image formation position is used as an image formation position for the current image forming process. This configuration prevents the accuracy of the image formation position from being decreased by the heat generated from the polygon motor 43.

While the disclosure has been described in detail with reference to the embodiment thereof, it would be apparent to those skilled in the art that various changes and modifications may be made therein without departing from the spirit of the disclosure.

The "image forming apparatus" is not limited to a color laser printer of a direct-transfer tandem type. The image forming apparatus may be of other types, such as an intermediate transfer type or a 4-cycle type. The image forming apparatuses include not only the color image forming apparatuses but also monochrome-only image forming apparatuses. The image forming apparatuses include not only a polygon scanning type but also an LED type and other electro-photographic image forming apparatuses.

The "operating parts" include not only the polygon motor 43 but also the fixing unit 33, for example. That is, the operating parts are rotating or heating bodies that generate heat when operating.

Figure 6:
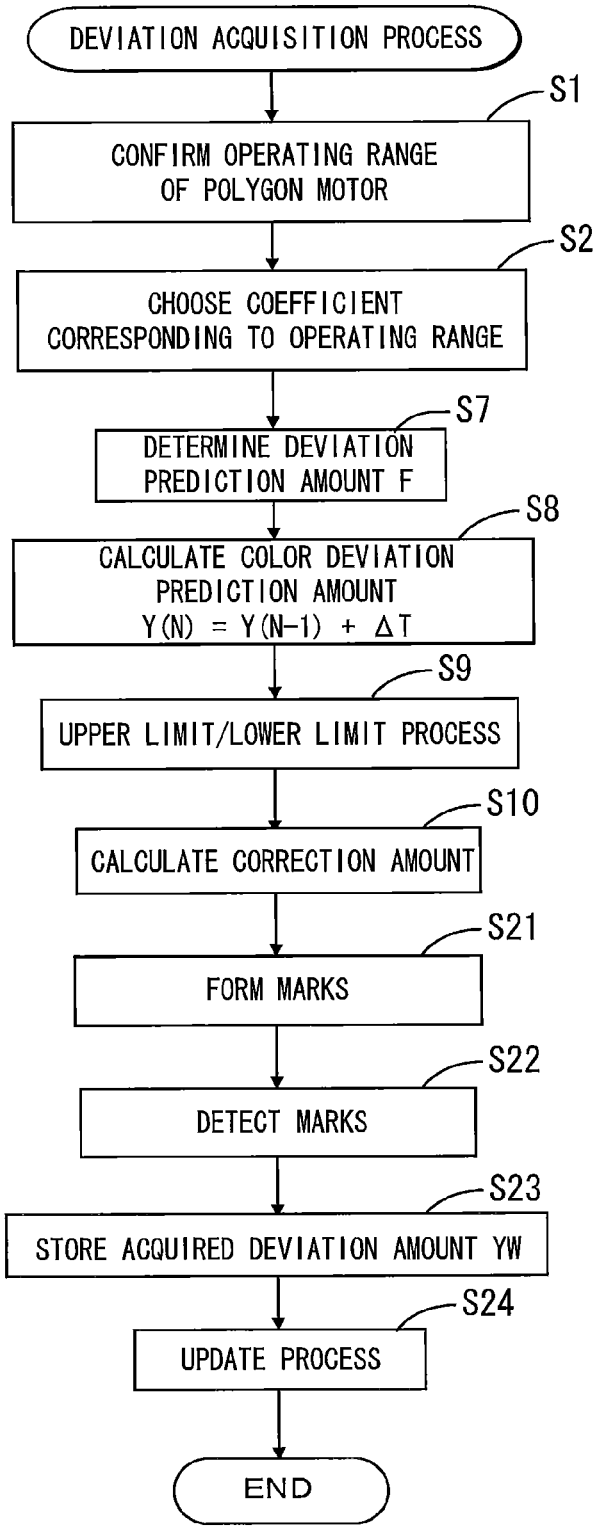
FIG. 6 is a flowchart illustrating steps in a deviation acquisition process.

The "control device" is one CPU 71 that performs each of the processes of FIGS. 4, 6, and 7. However, the disclosure is not limited to this. The control device may be a plurality of CPUs that perform each of the processes of FIGS. 4, 6, and 7; or a CPU and a hardware circuit that perform each of the processes of FIGS. 4, 6, and 7.

The adjustment process, which uses the adjustment amounts, may be applied not only to the deviation in the main scanning direction but also to the deviation in the sub-scanning direction. In this case, the adjustment amounts for the deviation in the main scanning direction may be equal to or different from the adjustment amounts for the deviation in the sub-scanning direction.

In the determination process of FIG. 4, the CPU 71 determines the adjustment amounts based on the rotation amount of the polygon motor 43 during the period from the previous image forming process to the current image forming process. As for the phrase "from the previous image forming process" or the phrase "after the previous image forming process", the period may start from the end of the previous image forming process or from the start of the previous image forming process. As for the phrase "current image forming process", the period may end at the start of the current image forming process, or may end right before the start of the current image forming process, or may end a predetermined time before the start of the current image forming process. The CPU 71 may determine the adjustment amounts based on the rotation amount of the polygon motor 43 during a period from an image forming process that is performed from before the previous image forming process to the current image forming process.

According to the above embodiment, as the polygon motor 43 is more frequently rotated, the deviation of the image formation position increases, and the CPU 71 therefore increment the adjustment amounts. However, the disclosure is not limited to this. If the deviation of the image formation position decreases when the polygon motor 43 is more frequently rotated, the CPU 71 may decrement the adjustment amounts.

In the determination process, the CPU 71 may not use the coefficients D. In such a case, a table showing the relation between the rotation amounts of the polygon motor in the elapsed time ΔT and the adjustment amounts may be previously stored in the nonvolatile memory 74; the CPU 71 may refer the table to determine the adjustment amounts.

In the determination process, the CPU 71 may measure the rotation amount of the polygon motor in the entire elapsed time ΔT, and determine the adjustment amounts based on the measurement results.

In S1 and S2 of FIG. 4, a table showing the relation between the ranges of elapsed time ΔT and the coefficients D1, D2, and D3 may be previously stored in the nonvolatile memory 74; the CPU 71 may directly choose one of the coefficients D1, D2, and D3 based on the acquired elapsed time ΔT. Alternatively, the CPU 71 may count the number of sheets printed per unit time, and choose one of the coefficients D1, D2, and D3 based on the counted number. In this case, the CPU 71 may count the number of sheets printed per unit time based on detection signals from the registration sensor 14.

In S2 of FIG. 4, the CPU 71 uses different coefficients D for each of the correction colors; the CPU 71 uses a larger adjustment amount for a correction color used by an optical system 44 adjacent to the polygon motor 43 to form an image. However, the disclosure is not limited to this. The CPU 71 may multiply the elapsed time ΔT by a value corresponding to a correction color, or may add a value corresponding to a correction color to the elapsed time ΔT.

In S5, the CPU 71 may change the elapsed time ΔT to larger value by adding a predetermined value or multiplying the elapsed time ΔT by a predetermined value, instead of the coefficients D1 to D3. In S6, the CPU 71 may change the elapsed time ΔT to smaller value by subtracting a predetermined value or dividing the elapsed time ΔT by a predetermined value, instead of the coefficients D1 to D3.

In S9, the CPU 71 may set the color deviation prediction amount to a value somewhere between the upper-limit amount YU and the lower-limit amount YL when the color deviation prediction amount is outside of the specified range. In this case, the range that is less than or equal to the upper-limit amount YU is an example of the specified range. The CPU 71 may not perform a process for the lower-limit amount YL. In this case, the range that is greater than or equal to the lower-limit amount YL is an example of the specified range.

In FIG. 4, the CPU 71 may proceed to S7 without performing S3 to S6 after performing the process of S2. If the result of S3 is NO, the CPU 71 may proceed to S5 without performing the process of S4. The CPU 71 may proceed to S4 without performing S3 after performing the process of S2. The CPU 71 may proceed to S10 without performing S9 after performing the process of S8.

What is claimed is:

1. An image forming apparatus comprising:

an image forming device having an operating part and configured to form an image at an image formation position on an imaging target; and a control device configured to:

control the image forming device to start performing an image forming process;

determine an adjustment amount regarding the image formation position based on an operation amount of the operating part measured during a period of time from a first specified timing in a previous image forming process to a second specified timing in or before a current image forming process, the previous image forming process being performed precedent to the current image forming process to form an image on an imaging target different from an imaging target on which the image is formed pursuant to the current image forming process; and adjust, based on the adjustment amount, the image formation position where an image is formed pursuant to the current image forming process, wherein the image forming device includes a light source, a polygon mirror, and a photosensitive body, the operating part being a polygon motor configured to rotate the polygon mirror, the polygon mirror being configured to reflect light from the light source to expose the photosensitive body to the reflected light, wherein the operation amount of the operating part is a rotation amount of the polygon motor, wherein the control device is further configured to control the polygon motor to rotate at one of a first rotation speed and a second rotation speed, the second rotation speed being slower than the first rotation speed, wherein an adjustment amount determined when a rotation speed of the polygon motor is the second rotation speed is smaller than an adjustment amount determined when a rotation speed of the polygon motor is the first rotation speed, and wherein the control device is further configured to choose one of a first coefficient and a second coefficient in accordance with the rotation speed of the polygon motor and determine the adjustment amount by using one of the first coefficient and the second coefficient whichever is chosen by the control device, the first coefficient corresponding to the first rotation speed, the second coefficient corresponding to the second rotation speed, the first coefficient being larger than the second coefficient.

2. The image forming apparatus according to claim 1, wherein the control device is further configured to determine the adjustment amount by multiplying the period by a coefficient variable dependent upon a unit operation amount indicative of the operation amount per a unit time during the period.

3. The image forming apparatus according to claim 1, wherein the control device is configured to increment the adjustment amount when the operation amount is larger than a reference amount and decrement the adjustment amount when the operation amount is smaller than the reference amount.

4. The image forming apparatus according to claim 1, wherein the image forming device includes a first optical system and a second optical system, the first optical system being configured to guide the light reflected by the polygon mirror to the photosensitive body, the second optical system being disposed closer to the polygon motor than the first optical system and being configured to guide the light reflected by the polygon mirror to the photosensitive body, and wherein an adjustment amount determined when the image forming device forms an image by using the second optical system is larger than an adjustment amount determined when the image forming device forms an image by using the first optical system.

5. The image forming apparatus according to claim 1, wherein a conveying body configured to convey a sheet of paper is designated as the image target, wherein the control device is further configured to control the conveying body at one of a first conveying speed and a second conveying speed slower than the first conveying speed, and wherein an adjustment amount determined when a conveying speed of the conveying body is the second conveying speed is larger than an adjustment amount determined when a conveying speed of the conveying body is the first conveying speed.

6. The image forming apparatus according to claim 1, wherein the control device is further configured to change the adjustment amount to fall within a specified range.

7. An image forming apparatus comprising:

a conveying body configured to convey a sheet of paper;

an image forming device having an operating part and configured to form an image at an image formation position on an imaging target and form a mark on the conveying body;

a detector configured to detect the mark, the detector outputting a signal when the mark is detected; and a control device configured to:

control the detector to detect the mark;

detect a mark formation position based on the signal outputted from the detector;

determine an adjustment amount regarding the image formation position based on an operation amount of the operating part measured during a period of time from a first specified timing in a previous image forming process to a second specified timing in or before a current image forming process, the previous image forming process being performed precedent to the current image forming process to form an image on an imaging target different from an imaging target on which the image is formed pursuant to the current image forming process; and adjust the mark formation position based on the adjustment amount, and set an image formation position corresponding to the adjusted mark formation position to a current image formation position for the current image forming process, wherein the image forming device includes a light source, a polygon mirror, and a photosensitive body, the operating part being a polygon motor configured to rotate the polygon mirror, the polygon mirror being configured to reflect light from the light source to expose the photosensitive body to the reflected light, wherein the operation amount of the operating part is a rotation amount of the polygon motor, wherein the control device is further configured to control the polygon motor to rotate at one of a first rotation speed and a second rotation speed, the second rotation speed being slower than the first rotation speed, wherein an adjustment amount determined when a rotation speed of the polygon motor is the second rotation speed is smaller than an adjustment amount determined when a rotation speed of the polygon motor is the first rotation speed, and wherein the control device is further configured to choose one of a first coefficient and a second coefficient in accordance with the rotation speed of the polygon motor and determine the adjustment amount by using one of the first coefficient and the second coefficient whichever is chosen by the control device, the first coefficient corresponding to the first rotation speed, the second coefficient corresponding to the second rotation speed, the first coefficient being larger than the second coefficient.

8. The image forming apparatus according to claim 7, wherein the control device is further configured to determine the adjustment amount by multiplying the period by a coefficient variable dependent upon a unit operation amount indicative of the operation amount per a unit time during the period.

9. The image forming apparatus according to claim 7, wherein the control device is further configured to increment the adjustment amount when the operation amount is larger than a reference amount and decrement the adjustment amount when the operation amount is smaller than the reference amount.

10. The image forming apparatus according to claim 7, wherein the image forming device includes a first optical system and a second optical system, the first optical system being configured to guide the light reflected by the polygon mirror to the photosensitive body, the second optical system being disposed closer to the polygon motor than the first optical system and being configured to guide the light reflected by the polygon mirror to the photosensitive body, and wherein an adjustment amount determined when the image forming device forms an image by using the second optical system is larger than an adjustment amount determined when the image forming device forms an image by using the first optical system.

11. The image forming apparatus according to claim 7, wherein the control device is further configured to control the conveying body at one of a first conveying speed and a second conveying speed slower than the first conveying speed, and wherein an adjustment amount determined when a conveying speed of the conveying body is the second conveying speed is larger than an adjustment amount determined when a conveying speed of the conveying body is the first conveying speed.

12. The image forming apparatus according to claim 7, wherein the control device is further configured to change the adjustment amount to fall within a specified range.

13. An image forming apparatus comprising:

a conveying body configured to convey a sheet of paper;

an image forming device having an operating part and configured to form an image at an image formation position on an imaging target and form a mark on the conveying body;

a detector configured to detect the mark, the detector outputting a signal when the mark is detected; and a control device configured to selectively operate in one of a first mode and a second mode, wherein in the first mode, the control device operates to:

control the image forming device to start performing an image forming process;

determine an adjustment amount regarding the image formation position based on an operation amount of the operating part measured during a period of time from a first specified timing in a previous image forming process to a second specified timing in or before a current image forming process, the previous image forming process being performed precedent to the current image forming process to form an image on an imaging target different from an imaging target on which the image is formed pursuant to the current image forming process; and adjust, based on the adjustment amount, the image formation position where an image is formed pursuant to the current image forming process, wherein in the second mode, the control device operates to:

control the detector to detect the mark;

detect a mark formation position based on the signal outputted from the detector;

determine an adjustment amount regarding the image formation position based on an operation amount of the operating part measured during a period of time from a first specified timing in a previous image forming process to a second specified timing in or before a current image forming process, the previous image forming process being performed precedent to the current image forming process to form an image on an imaging target different from an imaging target on which the image is formed pursuant to the current image forming process; and adjust the mark formation position based on the adjustment amount, and set an image formation position corresponding to the adjusted mark formation position to a current image formation position for the current image forming process, wherein the image forming device includes a light source, a polygon mirror, and a photosensitive body, the operating part being a polygon motor configured to rotate the polygon mirror, the polygon mirror being configured to reflect light from the light source to expose the photosensitive body to the reflected light, wherein the operation amount of the operating part is a rotation amount of the polygon motor, wherein the control device is further configured to control the polygon motor to rotate at one of a first rotation speed and a second rotation speed, the second rotation speed being slower than the first rotation speed, wherein an adjustment amount determined when a rotation speed of the polygon motor is the second rotation speed is smaller than an adjustment amount determined when a rotation speed of the polygon motor is the first rotation speed, and wherein the control device is further configured to choose one of a first coefficient and a second coefficient in accordance with the rotation speed of the polygon motor and determine the adjustment amount by using one of the first coefficient and the second coefficient whichever is chosen by the control device, the first coefficient corresponding to the first rotation speed, the second coefficient corresponding to the second rotation speed, the first coefficient being larger than the second coefficient.

* * * * *